United States Patent [19]

Takabayashi et al.

[11] Patent Number: 4,710,161

[45] Date of Patent: Dec. 1, 1987

[54] CONTINUOUS TYPE CENTRIFUGAL SEPARATOR

[75] Inventors: Kuniaki Takabayashi, Higashiosaka; Yoshitsugu Takaoka, Nara; Kouichi Hori, Hirakata; Masaki Shimotakahara, Katano; Kikujiro Okada, Ikoma; Satoru Shiino, Uji, all of Japan

[73] Assignee: The Green Cross Corporation, Osaka, Japan

[21] Appl. No.: 853,921

[22] Filed: Apr. 21, 1986

[30] Foreign Application Priority Data

Apr. 22, 1985 [JP] Japan ..... 60-85923

[51] Int. Cl.[4] ..... B04B 9/02

[52] U.S. Cl. ..... 494/84; 494/10; 494/18

[58] Field of Search ..... 494/18, 16, 35, 42, 494/10, 22, 84, 85

[56] References Cited

U.S. PATENT DOCUMENTS

| | | | |
|---|---|---|---|
| 4,109,855 | 8/1978 | Brown | 494/18 |
| 4,113,173 | 9/1978 | Lolachi . | |
| 4,221,322 | 9/1980 | Drago | 494/18 |
| 4,372,484 | 2/1983 | Larsson | 494/18 |

FOREIGN PATENT DOCUMENTS 51-120470 10/1976 Japan .

*Primary Examiner*—Robert W. Jenkins

*Attorney, Agent, or Firm*—Cushman, Darby & Cushman

[57] ABSTRACT

There is disclosed a continuous type centrifugal separator having simple structure in which the completedly closed system is realized, and which is suitable for separating the heavy and light components of the blood and usable for washing the blood of the patient.

10 Claims, 5 Drawing Figures

CONTINUOUS TYPE CENTRIFUGAL SEPARATOR

BACKGROUND OF THE INVENTION

1. Field of the invention

The present invention relates to a continuous type centrifugal separator, and more particularly to a continuous type centrifuge for washing the blood of the patient having blood disorders.

2. Related Background Art

In case of blood disorders such as jaundice, for example, it is observed that plasma is contaminated and the blood washing process is usually carried out for the treatment of the jaundice by way of continuously removing the blood from the doner patient, centrifugally separating the contaminated plasma to be abandoned, and returning red blood cells with addition of plasma preparations to the body of the patient under conditions flow process. Also, this washing process is being used for the treatment of various blood disorders resulting from abnormalities within the plasma, in such cases as malignant peraprotenemias and hypercholesterolemia.

For a continuous type centrifugal separator which can be used for the blood washing process as above mentioned, it is required that a closed system is kept in a flow process between the blood vessel of the patient and a centrifugal case via a circulation channel of the tubes for the whole blood and the separated blood components. Otherwise, bacteria contamination may possibly occur to cause hazards to the health of the patient. Therefore the most essential requirement for this type of a continuous centrifugal separator consists in an arrangement to ensure the completely closed system for the blood tubes.

Such a centrifugal liquid processor is disclosed in Japanese Patent Application Laid open No. 120470/1976 (corresponding to U.S. Ser. Nos. 562,748, abandoned, and 657,187, now Pat No. 4,113,173). In this prior art, a centrifugal case is positively rotated at the speed twice as high as an engaging member of blood tube, which is disposed on the position debiated from the rotational axis of the centrifugal case in the same direction thereof and the ratio of the speed of the case to that of the tubes is set to be ½ to eliminate any possible twisting of the blood tubes, thereby realizing the completely closed system in the continuous type centrifuge without using a rotary coupling for the connection between the centrifugal case and the blood tubes. However, the prior art is accompanied with such drawbacks that a driving mechanism for rotating the engaging member is so highly complicated that it is difficult to keep the rotation balance in case of high speed rotation, and the component parts of the apparatus may often be destroyed due to vibration.

SUMMARY OF THE INVENTION

It is an object of the present invention to provide an improved continuous type centrifuge in which the complicatedly closed, system is realized by greatly simplified structure.

It is another object of the present invention to provide a continuous type centrifugal separator comprising rotary member rotated around a predetermined axis;

connection means rotatably provided on said rotary member, the rotary axis of said connection means being in paralled with said predetermined axis and being deviated from said predetermined axis in a direction perpendicular to said predetermined axis;

centrifugal separation means rotatably provided coaxially with said predetermined pipe means connected to the center of said centrifugal separation means and extending therefrom to said rotary member, said pipe being rotatably held on said rotatory member and thereafter extending to said centrifugal separation means to pass on the predetermined axis, and the ratio of the speed of said rotary member to that of said centrifugal separation means being set to be ½ by utilizing the revolution of said connection means on its own axis and the revolution of said connection means around said predetermined axis.

Figure 1:
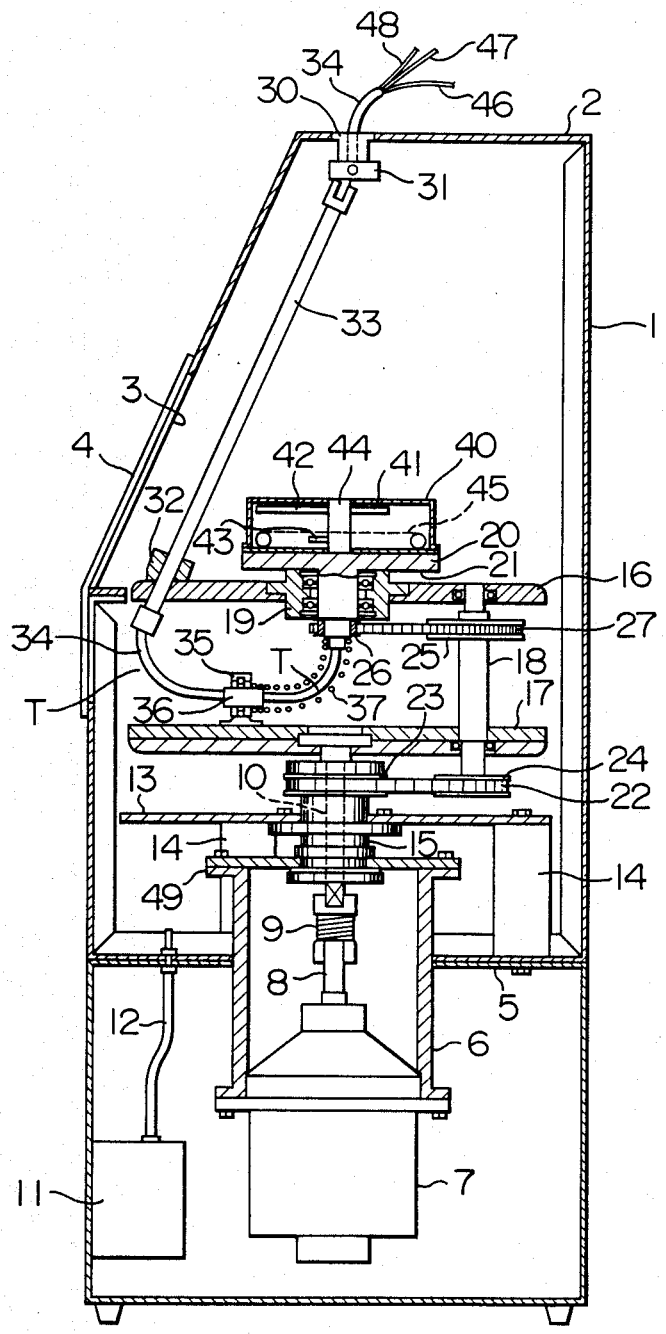
FIG. 1 is a schematic perspective view of the preferred embodiment according to the present invention.

DETAILED DESCRIPTION OF THE PREFERRED EMBODIMENTS:

FIG. 1 is a perspective view showing the whole structure of the continuous type centrifugal separator according to the present invention. The entire separator apparatus is accommodated in a housing 1 with an oblong square box-form. A transparent plate 4 is laid over so as to allow the sight inside of the apparatus. At the intermediate bottom 5 of the housing 1 is vertically fixed a cylindrical member 6, and a motor 7 is mounted at the lower end thereof. A motor shaft 8 is connected to a core shaft 10 via a flexible joint 9. At the lower past of the housing 1 there is provided a vacuum pump 11, and its suction pipe 12 is inserted into the intermediate plate 5 so as to have the internal pressure reduced to −200∼300 mmHg, thereby mitigating the noise attributable to the wind pressure during the rotation of the separator apparatus. A balance plate 13 is provided above the intermediate plate 5, and fixed thereto by the three supporting members 14 made of thick rubber and which are disposed at predetermined intervals. At the portion of balance plate 13 and the cylindrical member 6 there is fixed a sleeve 15 respectively, and its upper half part is projected upright over the balance plate 13. A spindle 10 connected with a motor shaft 8 passes through the sleeve 15 so as to enable it to be rotated under the low load through ball bearings of the sleeve 15 which are not shown in the drawing.

Upper and lower tables 16 and 17 are respectively provided in such a manner that the lower table is fixed at the top end of the spindle 10, and the peripheral portion of both the tables are connected to each other through a single connecting bar 18. When the lower table is rotated by the core shaft 10 through the drive of the motor 7 the connecting bar 1 is revolved around the core shaft 10 and the upper table 16 is rotated together with the lower table 17 in accompanyment with the connecting bar 18. In this concern, the connecting bar 18 is held by both the tables through the respective ball bearings, in such a way that it may be rotated readily with the low load. A centrifugal table 20 with smaller diameter the upper table 16 has its short tubular foot 21 inserted into a metal seat 19 which is coaxially fitted into the rotating central portion of the upper table 16. The tubular foot 21 is also coaxially disposed at the extended line part of the spindle 10, being rotatably held by the ball bearings of the metal seal 19. A timing belt 22 at the lower part is wound around a toothed pulley 23 fixed to the sleeve 15, and around a smaller diameter toothed pulley 24 mounted onto the lower end of the connecting bar 18. An upper timing belt 25 is wound around a toothed pulley 26 fixed to the tubular foot 21 of the centrifugal table 20, and around a toothed pulley 27 fixed to the upper part of the connecting bar 18. When the connecting bar 18 is revolved around the core shaft 10, the lower belt 22 is made to revolve round the axis of the pulley 23 fixed to the sleeve 15 of the core shaft. Owing to the engagement of the both, the lower belt 22 is moved by the pulley 23. Also the lower belt 22 is engaged with the pulley 24 having smaller diameter and which is mounted on the lower end of the connecting bar 18. The connecting bar 18 itself is rotated around its axis through the movement of the pulley 24, and its rotating movement is conveyed to the tubular foot 21 of the centrifugal table 20 via the upper belt 25 and the pulleys 26, 27 thereby positively rotating the centrifugal table 20 by means of the revoluting power of the lower belt as a drive force. The rotating speed of upper and lower tables 16, 17 is identical with that of the spindle 10, while that of the centrifugal table 20 is determined by comparison of ratio of diameters between the pulleys 23, 24 and the pulleys 26, 27. By properly selecting this ratio, the speed ratio between the centrifugal table 20 and the lower table 17 may be set to be 2:1.

Figure 4:
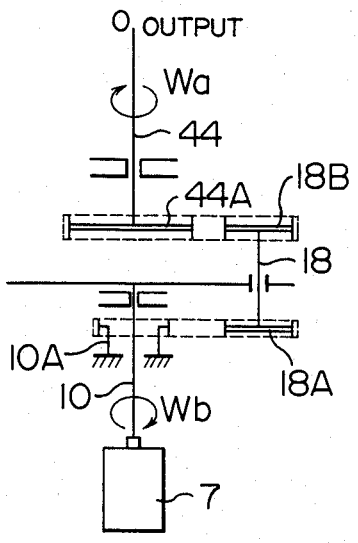
FIGS. 4 and 5 are explanatory diagrams for the mechanism employed in an embodiment according to the present invention.

Referring to FIG. 4, the above driving mechanism will be explained hereinafter. In FIG. 4, a toothed pulley 10A is fixed at the sleeve 15 which is stationary and therefore the toothed pulley 10A can not rotate. When the motor rotates at the speed Wb clockwise, the connecting bar 18 revolves around an axis 0. And since a toothed pulley 18A fixed at the lower end of the connecting bar 18 is rotatably connected to the toothed pulley 10A fixed at the stationary system through a timing belt, the connecting bar 18 revolves on its own axis. A toothed pulley 18B fixed at the upper end of the connecting bar 18 is rotated by the rotation of the bar 18 on its own axis and a toothed pulley 44A rotatably connected with the toothed pulley 18B through a timing belt is rotated around the axis 0 by the combination of the revolutions of the connecting bar on its own axis and around the axis 0.

The speed Wa of the toothed pulley 44A and the speed Wb of the connecting bar 18, that is, the speed of the motor shaft, satisfies the following relation.

$$Wa = \left(1 + \frac{D_{10A}}{D_{18B}} \cdot \frac{D_{18B}}{D_{44A}}\right) Wb$$

Wherein $D_{10A}$, $D_{18A}$, $D_{18B}$ and $D_{44A}$ are respectively pitch diameters of the toothed pulleys 10A, 18A, 18B and 44A. Accordingly, in the above embodiment, the desired ratio ($\frac{1}{2}$) of the speed of the motor to that of the centrifugal case is obtained by setting as follow:

$$D_{10A}=D_{18A}, \text{ and } D_{18B}=D_{44A}$$

Meantimewhile, a metal fitting 30 having an universal joint 31 is provided on the upper portion of the housing 1, as shown in FIG. 1, and the fulcrum of the universal joint 31 is positioned at the extension line of the rotation axis of the core shaft 10 and the centrifugal table 20. At the opposite end of the connecting bar 18 there is fixed a sleeve 32 on the peripheral side of the upper table 16, and a protective pipe 33 passes through the sleeve 32 to project downward from the upper table 16. By means of the protective pipe 33 and the connecting bar 16, the upper table 16 is held in such a manner as to vertically alive with the rotation axis. The protective pipe 33 is revolved on the conical plane by the rotation of the upper table 16 around the fulcrum of the universal joint 31.

A sheathed tube 34 is introduced into the protective pipe 33 through the metal fitting 30 and the universal joint 31 from outside of the housing 1. The sheathed tube 34 protected by the protective pipe 33 is loosely bent towards the lower table 17 starting from the lower end of the protective pipe 33, and the tube 34 is again bent towards upper direction in the vicinity of the central part of the lower table 17 so as to be inserted into the foot 21 of the centrifugal table 20. On the upper surface of the table 17 there is provided a ball bearing 35 having axis vertically to that of the rotation. The sheathed tube 34 is pressed into a metal casing 36 to be engaged with the lower table 17 by means of the ball bearing 35 and the metal tube 36 on its way to the insertion into the foot 21. As shown in the drawing, the curved portion of the tube 34 is surrounded by a plurality of coil springs 37, both ends of which are fixed by the foot of the centrifugal table and the metal seat, respectively. When it occurs that the tube 34 and the coil springs 37 are twisted by the rotation of the centrifugal table 20, the twisting thereof is eliminated by having the metal casing 36 rotated by using the reaction of the coil springs 37.

Figure 5:
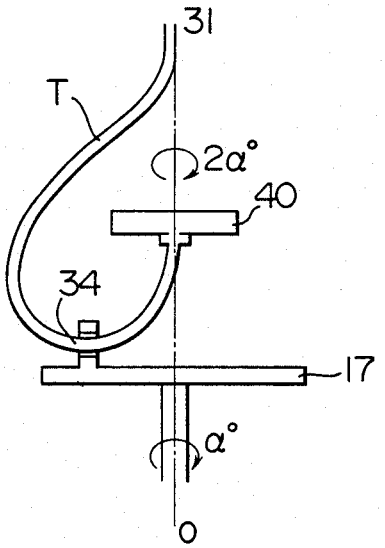

The reason why the twist is not caused in the tube 34 when the centrifugal table is rotated will be briefly explained hereinafter, referring to FIG. 5. FIG. 5 shows the basic mechanism of the present invention. Firstly, assuming that the tube 34 is fixed at the metal casing on the table 17, when the table 17 rotates clockwise by $\alpha$ degrees, the centrifugal case 40 is clockwise rotated by $2\alpha$ degrees. Under the above assumption, the tube 34 is rotated at the position at which the tubular metal 36 is located, by $\alpha$ degrees which is obtained from the difference between the angle ($2\alpha$) of the rotation by which the centrifugal case is clockwise rotated and the angle of the rotation which the table 17 is clockwise rotated. Further, the tube 34 is rotated in the universal joint 31 side by-$\alpha$ degrees by means of the U shape mechanism and the universal joint 31 is rotated around an axis 0 by-$\alpha$ degrees by means of the U shape mechanism and the universal joint 31 is rotated around an axis 0 by-$\alpha$ degrees. Therefore the twist caused in the tube 38 is absorbed as a whole. Accordingly in the apparatus according to the present invention, the twist is not caused in the tube 34 in spite of the connection between a rotating system (the centrifugal case) and a stationary system (the universal joint 31).

Figure 2:
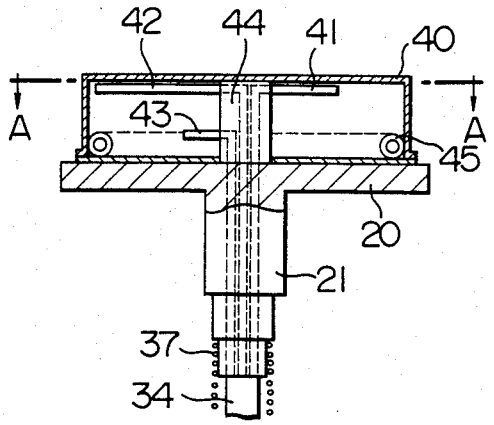
FIG. 2 is an enlarged longitudinal view of a centrifugal case of an embodiment according to the present invention.
Figure 3:
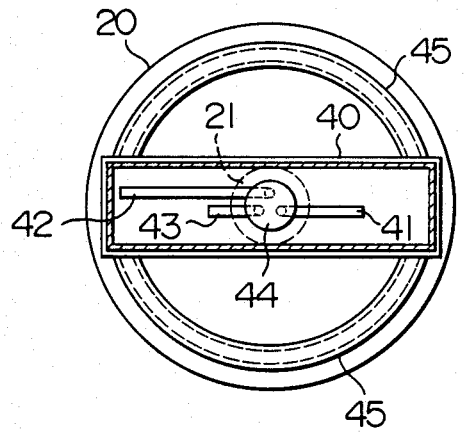
FIG. 3 is a sectional view taken generally along the line A—A of FIG. 2.

A centrifugal case 40 in the shape of a rectangular square box is mounted on the upper surface of the centrifugal table 20. In the case 40 there are accommodated a whole blood nozzle 41 having an inversed L shape as shown in FIG. 2, a nozzle 42 for heavy liquid component, a nozzle 43 for light liquid component, and a core bar 44 integral with the tubular foot 21 of the centrifugal table 20. Each of the roots of the nozzles is sealed in the core bar 44 to project into the foot 21 of the centrifugal table 20. The whole blood nozzle 41, has an opening in the middle of the right side along the upper surface of the bowl 40, while the heavy liquid nozzle 42 has it at the site near from the left end, and the light liquid nozzle 43 close to the central part of the lower surface of the bowl 40.

A communication pipe 45 consisting of a pair of semi-annular members is connected to both lower ends of the bowl 40 in the longitudinal direction so as to have them communicate each other in the opposite direction.

A group of tubes T consisting of whole blood tube 46, red blood cell tube 47, and plasma tube 48 are gathered together to be inserted into the sheathed tube 34, and the tube group T is introduced into the foot 21 of the centrifugal table, wherein the whole blood tube 46 is inserted into the base terminal of the nozzle 41, the red blood cell tube 47 into the nozzle 42, and the plasma tube 48 into the nozzle 43.

As stated above, since the centrifugal case is formed in the box-shape, and the semi-annular communicating pipe is connected to both ends of the bowl in the longitudinal direction, so that the heavy red blood cells are arranged to flow through this pipe, it is possible to improve the separation capability with such a simple structure.

The structure of the preferred embodiment according to the present invention has been described in the foregoing, and now the blood separating operation is explained hereinafter.

At first, saline liquid is brought into the whole blood tube 46 by means of the first pump (not shown in the drawing) for the input to the centrifugal bowl 40. This infusing liquid is filled in the bowl 40 as well as in the tubes 47, 48 for the red blood cell and the plasma, respectively. Then, the motor 7 is driven to rotate the spindle 10, which in turn rotates the upper and lower tables in cooperation with the connecting bar 18. While keeping the horizontal position of the upper table 16 by means of the connecting bar 18 and the protective pipe 33, the autorotation and revolving of the connecting bar 18 serves to rotate the centrifugal bowl 40. When the rotating speed of the bowl 40 reaches as high as the predetermined value such as 2,000 to 3,000 r.p.m., for example, the flow of the saline liquid is stopped, and the whole blood removed from the donor is added with an anti-coagulation liquid to be brought into the whole blood tube 46 by means of the first pump. This whole blood is sent into the centrifugal bowl 40 via the top end of the whole blood nozzle 41, and depending on the input volume of the whole blood the original infusing liquid is brought out of the centrifugal bowl 40 by means of the second pump (not shown in the drawing) of the red blood cell tube 47, thereby saturating the inside of the bowl 40 with the whole blood.

Owing to the high speed rotation of the bowl 40, the light component plasma is left in the central portion of the bowl, while the heavy component is separated from the plasma to be collected in the peripheral part of the bowl 40. Because the bowl 40 is designed to be shaped in the form of an oblong square box, performance for separating the red blood cell from the plasma is heightened. The communication pipe 45 consisting of a pair of semi-annular conduit members are connected to both ends of the bowl 40. Highspeed rotation of the bowl 40 makes the red blood cell to flow into this communication pipe, through which it flows in the opposite direction of the whole blood nozzle 41, heading for the red blood cell nozzle 42 to serve the purpose by this single nozzle only. Thus, the separation capability has been enhanced through the provision of the communication pipe 45 in the box-shaped centrifugal bowl 40.

After lapse of several minutes the whole blood in the bowl is completely separated, and then the second pump of the red blood cell (not shown) and the third pump of the plasma tube 48 (not shown) are operated to see that the red blood cell and the plasma which were separated in the bowl 40 are flown out through the nozzles 42 and 43, respectively. The red blood cell is brought into a mixture bag, and will be returned to the body of the patient after addition of the saline liquid and pharmaceutical agent, whereas the plasma is sent into the bag for abandonment. In case of the jaundiced patient, the plasma is contaminated and it shall be abandoned. A venous needle used for returning the red blood cell to the body of the patient shall be provided with a bubble detector in order to obviate the risk of mingling with air.

Once the separating operation as abovementioned is started, the blood is continuously removed from the donor patient, to be followed by the continuous steps for separating the whole blood, returning the red blood cell to the body of the patient, and abandoning the plasma into the bag, thereby attaining the objective to wash the total volume of the patient's blood in a continuous flow of circulation.

This concern, the total content volume of the bowl 40, and the tubes 46, 47, 48 should preferably be predetermined to be about 130 ml, thereby reducing the temporary outflow volume of the patient's blood so as to alleviate the physical burden to enable the therapy for the aged and the inlant as well.

Upon completion of the blood washing process, the infusing liquid is again sent into the bowl 40 through the whole blood tube 46, and the separated red blood cell in the total volume is returned to the body of the patient to prevent the waste of the blood, while serving to wash also the inside of the bowl 40 and its related parts by the use of the infusing liquid.

In the present embodiment of the invention, the whole blood tube 46 is directly inserted into the nozzle 41 of the bowl, and the red blood tube 47 to the nozzle 42, thus ensuring completely enclosed system without using any means of rotary joint or the like for any parts of the tubes. For this reason, there is no problem of bacterial contamination, showing extremely excellent sanitary condition for the operation.

The foregoing has been an explanation on the preferred embodiment of the present invention, which shall not be defined in this embodiment only, and any suitable change in the design of the structure may be made within the purport of the present invention. For examples, the timing belt and the toothed pulley may be substituted by V-belt and V-pulleys, or a gear assembly may be used. Also it is possible to have such an arrangement as to enable the leukocyte to be removed from the donor's blood by the provision of the leukocyte nozzle and leukocyte tube, besides the heavy liquid nozzle 43 and red blood cell tube 46 as well as the light liquid nozzle 43 and the plasma tube 48.

Incidentally, in the preferred embodiment of the present invention the explanation has been made with regard to the therapy for the jaundice, but it is also possible to apply the present invention to the mere purpose for separating the whole blood from the donor, whereby the plasma may be utilized for the plasma preparations without throwing away the plasma of the donor, while the red blood cell requiring long time for regeneration shall be returned to the donor.

Although not shown in the drawings of the preferred embodiment, the red blood cell tube is usually provided with a branch tube and a changeover valve in the practical type of a blood cell separator, which allows the RPM of the centrifugal bowl to be regulated for the possibility of removing the leukocytes or platelets from the whole blood of the donor or the blood disease patient.

It is ensured that the completely enclosed system can be attained by greatly simplified structure according to the invention, and the long-term operation can be performed with safety and under extremely sanitary conditions without any risk of biological contamination.

What is claimed is:

1. A continuous type centrifugal separator comprising:

rotary means rotating around a predetermined axis;

connection means rotatably provided on said rotary means, the rotary axis of said connection means being in parallel with said predetermined axis and being deviated from said predetermined axis in a direction perpendicular to said predetermined axis;

centrifugal separation means rotatably provided coaxially with said predetermined axis;

supply/discharge means, one end of said supply/discharge means being connected to said centrifugal separation means, said supply/discharge means extending therefrom to a predetermined position of said rotary means and at the predetermined position being rotatably held on said rotary means and the other end extending outside of said separator, passing on said predetermined axis; and rotary driving mechanism means including means for rotating said connection means around said predetermined axis and rotating said connection means on its own axis, and means for rotating said centrifugal separation means at the half speed of said rotary means by the rotations of said connection means.

2. A continuous type centrifugal separator according to claim 1, further comprising first transmitting means and second transmitting means, said first transmitting means comprising a first toothed pulley fixed at said connection means, a second toothed pulley fixed on the stationary system and a first belt wound around said first and second toothed pulley, and said second transmitting means comprising a third toothed pulley fixed at said connection means, a fourth toothed pulley fixed at the rotary axis of said centrifugal separation means and a second belt wound around said third and fourth toothed pulleys.

3. A continuous type centrifugal separator according to claim 2, wherein said stationary system is a sleeve of the rotary axis of said rotary member 4. A continuous type centrifugal separator according to claim 2, wherein said first and second belt are tuning belts.

5. A continuous type centrifugal separator according to claim 1, wherein said rotary member comprises an upper and lower table, and said connection means connects said upper table with said lower table so as to rotated together.

6. A continuous type centrifugal separator according to claim 5, wherein said centrifugal separation means is rotatably held on said upper table.

7. A continuous type centrifugal separator according to claim 6, wherein said separator is used for washing the blood of the patient.

8. A continuous type centrifugal separator according to claim 1, wherein said centrifugal separation means has a rectangular box shape and both ends of said centrifugal separation means in a longitudinal direction are connected each other with a communicating pipe having a semi-annular shape.

9. A continuous type centrifugal separator according to claim 1, wherein said pipe is rotatably held on said rotary member through a bearing, a coil spring is provided so as to surrounding said pipe, the both ends of said coil spring are respectively fixed to said centrifugal separation means and to the bearing at the portion thereof fixed to said pipe.

10. A continuous type centrifugal separator according to claim 1, wherein said separator is used for separating the light and heavy components of the blood.

* * * * *